United States Patent [19]

Krzes

[11] 4,365,811

[45] Dec. 28, 1982

[54] BATTLE TYPE GAME AND KIT FOR CONSTRUCTION THEREOF

[76] Inventor: Casey S. Krzes, 1198 Meadow La., Grand Island, N.Y. 14072

[21] Appl. No.: 104,017

[22] Filed: Dec. 17, 1979

[51] Int. Cl.[3] ..... A63F 3/00

[52] U.S. Cl. ..... 273/238; 273/265

[58] Field of Search ..... 273/238, 265, 275, 139; 434/338; 35/9 C, 19 A; 339/276 A

[56] References Cited

U.S. PATENT DOCUMENTS

| | | | |
|---|---|---|---|
| 1,518,845 | 12/1924 | Foley et al. | 273/139 |
| 1,988,301 | 1/1935 | Coffin | 273/265 |
| 2,013,958 | 9/1935 | Hughes | 273/139 |
| 2,197,306 | 4/1940 | Ingraham | 273/139 UX |
| 3,085,803 | 4/1963 | Krzes | 273/238 |
| 3,104,878 | 9/1963 | Roger | 273/265 |
| 3,113,777 | 12/1963 | Senick | 273/265 |
| 3,206,871 | 9/1965 | Schure et al. | 434/338 |
| 3,649,743 | 3/1972 | O'Loughlin | 339/276A |

FOREIGN PATENT DOCUMENTS

| | | | |
|---|---|---|---|
| 2005753 | 8/1971 | Fed. Rep. of Germany | 273/238 |
| 1564925 | 1/1967 | France | 273/238 |

OTHER PUBLICATIONS

Electronic Puzzles & Games; p. 73 et seq.; M. Mandl; Gernsback Library; ©1958.

*Primary Examiner*—Richard J. Apley
*Assistant Examiner*—Carl Moy
*Attorney, Agent, or Firm*—Raymond F. Kramer

[57] ABSTRACT

A battle type game, which is readily constructed, includes simple electric circuitry for actuating signals to indicate hits made. The signals are actuated by completion of an electric circuit due to contact of an electrically conductive piercing portion of a piercing probe member, which may be a bulletin board type tack, with an electrically conductive head portion of a contact member, which may be a substantially flat headed metal thumbtack, representing a target or a part thereof. The invention is preferably made from a kit of components, readily assemblable by a youthful prospective player of the game. Also within the invention is the provision of cover sheets, having grid indicia thereon, for use to cover a corresponding marked sheet on a circuit board, for playing of the game, on which the target members are placed. Employment of a simple paperboard or similar box structure for holding and concealing the contact members and circuitry of the game and for supporting a covering surface member, on which game indicia are present, is a preferred inventive feature.

6 Claims, 4 Drawing Figures

BATTLE TYPE GAME AND KIT FOR CONSTRUCTION THEREOF

This invention relates to a game of the battle type, wherein the object is for a player to determine the whereabouts of a previously selected location or a plurality of such locations not known to him or her, which represents a target or a plurality of targets. More particularly, the invention is of a game, and a kit for its manufacture, in which piercing or penetrating movement of an electrically conductive portion of a probe completes an electric circuit when contact is made with pre-set contact members to complete a circuit and activate a signal, such as a lamp, to indicate the existence of a hit and to identify the target that has been hit.

Battle type games have been favorites of young people for many years. Such games, in which one player deploys or hides his fleet by marking a grid, and the other player seeks to locate it, while originally played with pencil and crosshatch or graph paper, have been described in various patents as being playable by utilizing electrical circuits and signals which indicate when a hit has been made. Such games have been referred to as Salvo, Battle, Naval Combat, Submarine and Battleship. Among the more relevant patents found in a search in the U.S. Patent and Trademark Office public searchroom files, covering subclasses 273-139; 273-237; 273-238; 273-262 and 273-265, were U.S. Pat. Nos. 2,579,454; 3,085,803 (granted to the present inventor); 3,537,708; 3,640,536; and 3,697,076.

Unlike the electrically actuated games of this type in the prior art, the present invention may be made from comparatively cheap components and may be assembled by a young person who is a prospective player of the game. Thus, the price of the game may be kept low and the player may have the additional pleasure of having had a part in the construction of the game with which he is playing. Furthermore, unlike commercial games of this type, should any connections come loose, the player can readily repair them.

In accordance with the present invention, a game, in which the object is for a player to determine the whereabouts of a previously selected location not known to him or her, comprises a visible surface member with an indicated plurality of locations thereon, a separable circuit board member associated with the visible surface member but hidden from a player of the game, an electrically conductive contact member removably fastenable in place above any of a plurality of locations on the circuit board corresponding to indicated locations on the surface member, an electrical conductor in electrical contact with the contact member and communicating with a source of electricity, and a probe communicating with the source of electricity and capable of making an electrical contact with the contact member, so as to complete an electric circuit with the source of electricity, the contact member and the conductor, when in such contact, and electrically actuatable signal means in said circuit, so that when the probe is in contact with the contact means the signal is actuated.

Preferably, the game comprises a plurality of electrically conductive thumbtack type members of metal, with substantially flat heads and pointed shanks, a bulletin board tack type member having an elongated nonconductive handle and a conductive pointed metal shank, conductive wires, electrically connected to the thumbtack type members and to the bulletin board tack type member by being wrapped around the conductive shanks thereof, a plurality of electrically actuatable signals, a source of electricity, a surface member, a circuit board member and a grid sheet to be held in place on top of and as a visible part of the surface member, all of which are assembled into such game so that contact of the point of the bulletin board tack type member with the head of a thumbtack type member, made when the bulletin board tack type member passes through a grid sheet and the surface member, actuates an electrically actuatable signal by completing an electric circuit in which the signal is a part.

The invention also relates to a game which comprises an electrically conductive thumbtack type member, an electrically conductive probe member and a signal, which signal is actuated by an electrical contact made between the thumbtack type member and the probe member so that electricity carried by an electrical conductor from a source of electricity will actuate the signal due to completion of an electrical circuit by the contact made. The invention is also of a kit, which, in its broadest aspects, is for making a game of the type described by me herein and which comprises a plurality of electrically conductive thumbtack type members, a bulletin board tack type member having an electrically conductive point portion, conductive wires, a plurality of electrically actuatable signals, a surface member and a circuit board member, all assemblable into a game in which contact of the point of the bulletin board tack type member with the thumbtack type member, made when the bulletin board tack type member passes through the surface member, can actuate the signal when a battery or other source of electricity is included in an electric circuit which is completed by such contact.

The invention and its various aspects and advantages will be readily understood from the present specification, especially the following description, taken in conjunction with the drawing in which.

Figure 1:
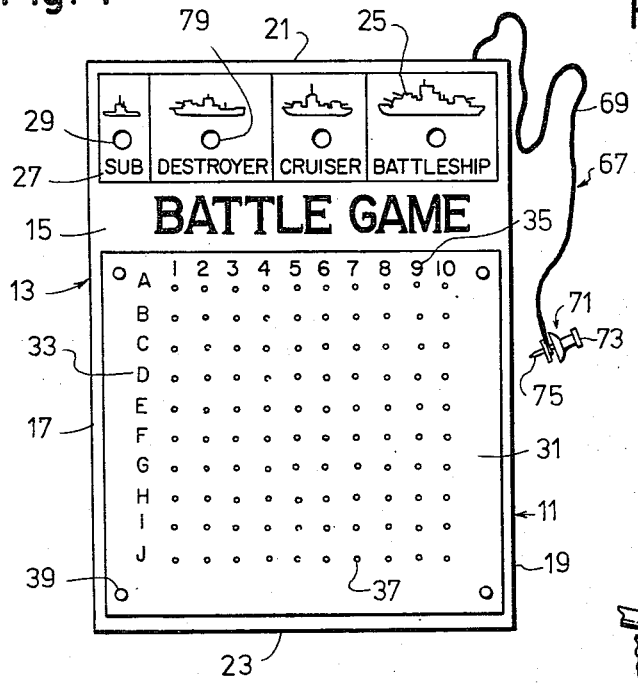
FIG. 1 is a top view of the game, showing the grid, signals and probe.

In FIG. 1, in the embodiment of the present game illustrated, designated by the numeral 11, visible surface member 13 includes a surface portion 15, which is the flat top of a comparatively flat box having side walls 17 and 19 and end walls 21 and 23, which, in the illustration given, extend downwardly between 1 and 3 centimeters, e.g., 2 cm. Also, in the embodiment illustrated, the box is from 15 to 40 cm. long, e.g., 21 cm. and from 10 to 30 cm. wide, e.g., 16 cm. On the top of the surface member, in addition to indicia 25, pictorially representing various types of targets, in the case illustrated, with the particular numeral designating a battleship, and the names of the objects of such indicia 27 (designating a submarine) plus the name of the game, there are present openings 29 through which the illumination of signal lamps may be viewed when a "hit" is made by a player of the game. Also illustrated on the game surface member is a sheet 31, the one shown being intended to be of paper, having on it letters 33 and numerals 35 to permit ready identification of the various positions of grid indicia. For example, that position designated by numeral 37 is identifiable as J8. Grid sheet 31 is shown held to the surface member or the flat cover of box 13 by fasteners 39, shown as small tacks, but other fastening or mounting means may be used instead.

Figure 2:
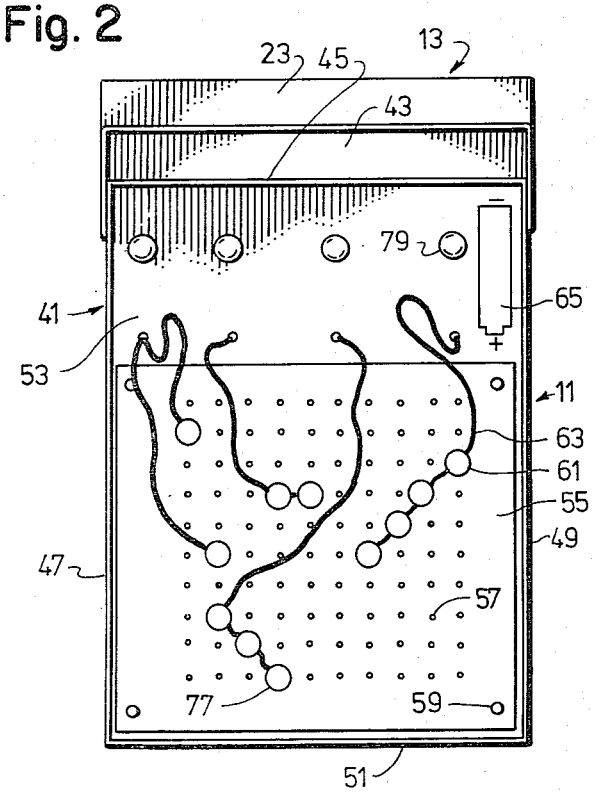
FIG. 2 is a top plan view of the game with the cover or surface member of FIG. 1 opened by rotation to open position, about 90° from closed position, showing the circuit board, contact members, conductive wires, signals and battery source of electricity, but omitting the probe.

In FIG. 2 cover 13 is shown in opened position so as to expose circuit board member 41. In the illustration numeral 43 designates the under side of the cover or surface member. As shown, the cover is hinged to the surface board member, which latter member is in the shape of a box bottom of dimensions slightly smaller than those previously given from the top. However, hinging is not necessary, although it may be desirable, especially if one wishes to place the signal lamps or any other mechanism, together with electrical connections, etc., on the top or under surface of the "visible surface member." The hinge mechanism for connecting top and bottom is not specifically illustrated in the figures because it is not essential and because FIG. 2 may be considered as showing a separate cover member in position but tilted open, rather than being hinged. If the box parts are hinged together it is preferred that this be effected by fastening together cover member back end 21 and the corresponding end 45 of the circuit board member.

Circuit board member 41, as illustrated, includes a box-like structure, having a flat bottom, not shown, upwardly extending side walls 47 and 49, and end walls 45 and 51. The boxes are desirably of the structure shown so as to be able to contain a battery source of electricity, which will be described subsequently, and lamps, and to allow room for penetration of the actual circuit board by contact members, preferably tack-like in shape and function. Therefore, to bring the visible portion of the circuit board 53 up to a height approximating the tops of the sides and ends of circuit board member 41, corrugated paperboard, not shown, may be inserted below the visible (when the game is opened, as in FIG. 2) circuit board, shaped as may be desirable to conform with the shapes of inserted lamps, batteries, etc. The top or upper surface of the circuit board 53 may have grid-like indicia or openings therein conforming to those of the covering surface member 15, as shown on grid sheet 31. Preferably, as illustrated in FIG. 2, a sheet 55, with grid markings 57 thereon, is used, which sheet may be identical with sheet 31. Such sheet is held to the visible portion 53 of circuit board member 41 by suitable means, which in FIG. 2, are shown as tacks or fasteners 59, at the four corners of sheet 55. It is important that openings or indicia 57 of the circuit board, as shown in FIG. 2, should conform with similar openings or indicia 37, as shown in FIG. 1, so that, as will be described, if a player of the game should guess or otherwise determine the location of a target, an appropriate signal will be actuated upon insertion of a probe member at the correct location.

On circuit board member 41 contact members 61 are suitably positioned at various grid locations, which locations are those identified by grid indicia positions, such as that indicated at 57. Such contact members are located singly, as for the two submarines, or in sets, two at adjacent grid locations, for a destroyer, three at adjacent grid locations for a cruiser and four at adjacent such locations for a battleship. Of course, if desired, five adjacent locations may have contact members inserted thereat, to represent a super aircraft carrier, etc., and the combinations and the numbers thereof may be varied. It is noted that such locations should be in a straight line but are not restricted to the horizontal and vertical, with diagonal orientation also being permissible. In some instances locations may be non-linear. Thus, a square could represent another target, such as a harbor or a refueling installation.

The various contact members are connected by metal conducting members 63, preferably copper or aluminum wire, to a battery 65 or other suitable source of electricity. The wiring diagram illustrates the contacts of the various conductive members or wires with the battery and the various related means for completing the circuit to actuate various signals. Such circuit diagram will be discussed further later. Referring now to FIG. 1, which better illustrates the probe, which is not shown in FIG. 2, so as to allow more room for positioning of designating numerals, probe member 67 includes a conductive member or wire portion 69 and a contact making part 71, which includes a bulletin board type tack or fastener 73 having a conductive point 75. The details of such probe member and of the contact member are better shown in FIG. 3 and will be described more fully in the description of such figure. When contact is correctly made between the conductive point 75 of probe member 67 with the conductive head 77 of contact member 61, which is preferably like a metal thumbtack, an electric circuit is completed and an appropriate lamp 79 is illuminated, signaling such contact and identifying the target hit.

Figure 3:
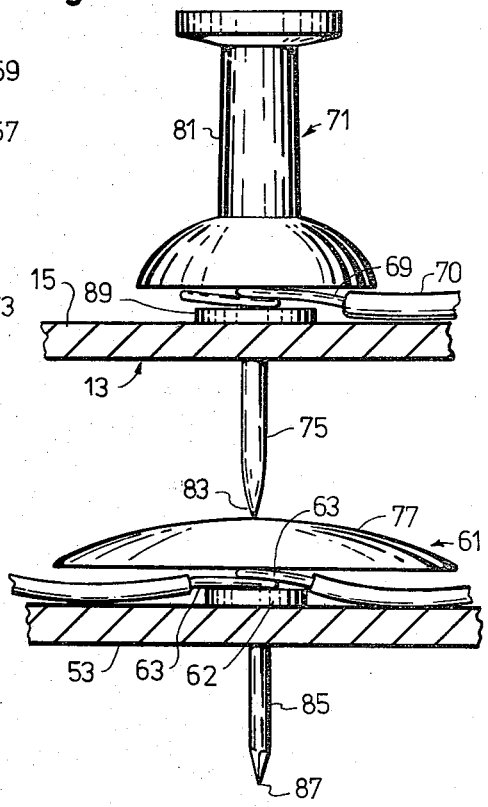
FIG. 3 is an enlarged view of a bulletin board tack type of probe member part, shown penetrating the surface member and contacting the conductive top of a contact member which is held in position on the circuit board.

In FIG. 3 the bulletin board tack-type probe member part 71 is shown to include a non-conductive or handle portion thereof 81 and an electrically conductive point portion 75, pointed at the lower end thereof 83, piercing the surface 15 of surface member 13 (sheet 31, being very thin, is not shown at FIG. 3) and contacting the conductive top or head 77 of conductive contact member or tack 61, which head is connected to a conductive piercing portion 85 of such tack, which has a point 87 at the lower end thereof, said piercing portion being shown inserted through circuit board 53 (grid sheet 55 is not illustrated).

Still referring to FIG. 3, insulated electrical conductor 69 is shown wrapped around the electrically conductive penetrating pointed portion 75 of probe 71 (it may also be soldered or otherwise electrically joined thereto, if desired) so that the conductor and the electrically conductive point portion of probe 71 can form part of an electric circuit. Sometimes it may be preferred to use uninsulated wire but to avoid short circuits, especially between conductors on the circuit board member, insulation, shown at 70 and elsewhere, is preferred. It will be noted that synthetic organic polymeric washer or disc (although other shapes than discs may also be used) part 89 is pressed onto the pointed part of the probe so as to hold wire 69 in place thereon, due to the facts that the opening (not shown) in such plastic part is smaller than the diameter of the pointed portion of the probe, and the plastic possesses desirable resiliency. A similar fastening of conductor 63 to contact member 61 by disc 62 is illustrated, with wires 63 being shown held in electrical contact with point part 85, and through it, with head 77 of contact member or thumbtack 71. Thus, when wire 69 and one of wires 63 are connected to different poles of battery 65 or to different poles of another source of electricity, with a signal lamp or other signal means in the circuit, by contact of point 83 with head 77 electricity flows and the signal is actuated (the lamp is lit).

Figure 4:
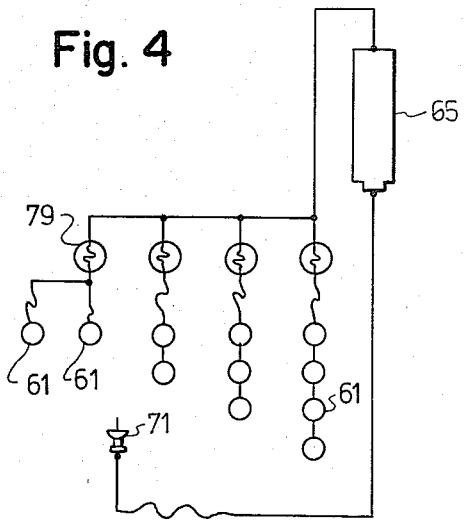
FIG. 4 is a circuit diagram of the game.

FIG. 4 requires little further discussion, it being evident, for example, that the circuitry is such that when either submarine is "hit" by contact between probe 71 and an appropriate contact member 61, light 79 (as specifically identified in FIG. 4) will be illuminated. Thus, when the game is in closed position, as shown in FIG. 1, when a hit is made and the electric circuit is completed, the appropriate lighted lamp will be seen through opening 29.

The playing of battle games, such as battleship, or other games of the present type, is so well known as not to require a lengthy description. Suffice it to say that one player will position his ships, as shown in FIG. 2, without letting the other player see their locations, and the other player, after closing up of the game, will attempt to find those locations by appropriate positionings of the probe member. Preferably, two game units will be employed and each player will both deploy his fleet and fire at the other fleet in an attempt to sink his opponent's ships, with the winner of the game being the player who first accomplishes this. Players' turns may comprise single or several gun firings. The game can be played with only one unit, being set by one player and played by the other, after which the second player may set the circuit board and the first player may attempt to locate the fleet, with the winner being the one who accomplishes the destruction of his opponent's fleet in the fewest attempts or turns. The shots taken or salvos fired may be indicated by appropriate means, as by the insertion in the particular location of an indicating peg of appropriate color to denote a hit or miss or by marking the paper sheet on which the grid is printed or through which it is perforated. The mentioned pegs may be color coded or otherwise identified to show which type of target was struck and if the sheet is marked by a writing implement, a code to show that may be employed. After a few uses of the game, when paperboard covers and bases are employed (the bases preferably including corrugated paperboard members to support the contact members), the surface member of the circuit board and any grid sheet on it will probably be pierced at all grid locations, and in such instances it may be especially desirable to utilize new grid sheets to cover the surface member so as to prevent any possible viewing by a player of the contact members through the openings in the surface member. Sometimes this may also be desirable after a single use. To prevent such viewing of the targets, they may be made of non-reflective conductive material or may be coated with pierceable non-reflective coatings.

It will be seen from the foregoing description that the present game is inexpensive to make, easy to play and deceit-proof. It has the advantage over battle and battleship games of the manual or non-signaling type that one player does not have to depend on the other player to indicate when a hit is made. This avoids arguments between youthful players, caused by unintentional errors or by intentionally incorrect reports as to the results of a shot or salvo. The game is more fun to play than various other battle games because of the signals which are actuated by the electrical contact made by insertion of the probe at a correct location. Of course, the probe may be modified to be in the form of a shell, missile, rocket, torpedo or other projectile, so as to increase the realism of the game. Similarly, instead of tacks being employed, the contact members may be shaped somewhat like ship parts, providing that they are electrically conductive. Still, for most purposes the use of items like bulletin board tacks and thumbtacks is contemplated because these are readily available, may be easily replaced if lost, and are inexpensive and effective.

In one of the prior art battle games presently being marketed at a high price, visual and aural signals are actuated when targets are struck, but the game takes so much time to set up that it discourages play by most children. Also, while such a game is highly sophisticated, it does not possess the desirable complexity of the present game in the setting of the targets, since no diagonally positionable targets are included in the commercial game. The present game is cheap to manufacture and can be sold at a low price. Better yet, it may be sold in kit form for easy assembly by the young players, thereby giving them experience in constructing their own game, some acquaintance with principles of electricity, and the satisfaction of being able to accomplish a useful task. It is also easy to set and play and setting and playing can be effected quickly and do not require any special knowledge or talents. The only parts that may need replacement are the battery, lamps and grid sheets, so maintenance is minimal.

The kits from which the present games may be made may include materials to make one or more of the game units but usually materials for two such units will be provided, with additional spare parts. The box parts, corrugated board "spacers," thumbtack-type contact members, bulletin board-type probe members, wires, signals (usually lamps) and grid sheets may be supplied and a battery or batteries may or may not be included in the kit. Instead of or in addition to lamps, audible signals, such as buzzers, may be utilized. For additional effects, the lamps utilized may be of the flashing or intermittent signaling type. Instead of a battery, there may be provided with such a kit a small transformer or a converter to supply low voltage electricity, e.g., from 1.5 to 9 volts, preferably d.c. If a battery is supplied, it may have contacting means with it, or such means may be included in the kit. Such means can be conventional snap-on clamps or, if desired, conductor wires may be fastened to the positive and negative ends of the battery, for further fastenings to other conductors. The lamps utilized may be threaded or of the bayonet type for socket insertions or, preferably, may include contact wires extending therefrom, which may be twisted with other wires to complete the desired circuitry. The lamps may be held in place or lamp sockets may be held in place by various means but it is most preferred to utilize simple pressure sensitive tape, such as that which is sold under the Scotch trademark. The lamps may project upwardly from the upper surface of the game but for protection of the assembled game, whether or not made from a kit, it is preferable that the lamps be underneath the upper surface, with an opening in the upper portion of the game so that lighting of the particular lamp may be noted.

The preferred materials of construction of this invention have been mentioned but it must be understood that these can be varied and it is contemplated as being within the invention to utilize other shapes for the game than the boxes described. One may also employ various other materials, such as synthetic organic polymeric plastics, wood and other suitable non-conductors for the box parts, although metals may be used selectively for certain parts. The boxes may be supplied as paperboard sheets, such as cardboard sheets, which are to be cut and folded to shape, with the corners being taped. After the circuit board lower box portion and the cover box portion have been made, and after suitable shaping of the supporting corrugated board or other equivalent material to accommodate the lamps, battery, wires, etc., has been completed, and such corrugated board has been inserted in the bottom portion of the box, the indicia sheets are lined up (this may be done in advance by printing the box portions to indicate where the folds are to be made, where the indicia sheets are to be placed, etc.), the various conductors are connected to the contact members, preferably by the method illustrated in FIG. 3, and the probe bulletin board tack type member is similarly connected to a conductive wire. Then the various conductive wires and the signals are connected into the desired circuitry, shown in FIG. 4. Of course, variations can be made on such circuitry, which will be known to those of skill in this art. Of course, instructions for assembly and a circuit diagram are very preferably included with the other kit parts. If desired, some of the subassemblies may be included in the kit. For example, the various sets of contact members may be pre-assembled. Also, while bulletin board tacks and ordinary metal tacks are preferred, substitutes for them may be employed. With respect to the metal tacks or other contact members, it will be noted that the heads thereof will be sized so that even when there is a slight misalignment of the grids the appropriate signal will still be correctly given and such will occur even if a youthful player of the game does not direct the probe exactly at the mid-point of the surface grid marking. In other words, there is a margin for error, but the heads are so sized that no signal will be given when the probe is inserted in or penetrates an incorrect opening, marking or indentation.

Use of the box type construction of the present invention permits sealing of the game with a suitable cellulose tape or similar material so that if the game is opened by one of the players to change the positions of the contact members such seal will have to be broken. This gives the game additional security, which can be important to the players.

Of course, many variations of the present battle game may be made, to accommodate it to the times, and are within this invention. For example, instead of playing battleship, the game may be related exclusively to submarines, in which case it is more realistic because it is primarily one of attempting to find the location of a target, and submarines, being below the surface of the water, have to be so located, whereas surface ships are usually visible. With respect to such a submarine game, the various combinations of contact members may be employed to designate one-man submarines, conventional submarines, nuclear submarines, etc. Also, the grid of the game may be appropriately printed and colored to resemble ocean waves with the grid markings being unobtrusive.

It will be evident to one of skill in the art that various substitutes and equivalents may be employed without departing from the present invention.

What is claimed is:

1. A kit for making a game of the battleship type which comprises a plurality of electrically conductive thumbtack type contact members of metal, with substantially flat heads and pointed shanks, and an electrically conductive headed and pointed probe, having a conductive pointed metal shank, electrically conductive wires, a plurality of electrically actuatable signals, a surface member, a circuit board member and a plurality of grid sheets to be individually held in place on top of and and as part of the surface member, all of which are assemblable into a game in which contact of the point of the probe with a head of a thumbtack type contact member, made when the probe passes through a grid sheet and the rest of the surface member, actuates the signal when a battery or other source of electricity is included in the electric circuit which is completed by such contact, including a plurality of synthetic organic polymeric plastic washers for use as holding means for holding conducting wires in contact with the thumbtack type contact members and the probe, which washers include openings smaller than the shank diameters of the thumbtack type contact members and the probe so that after installation on such shanks the resiliency of the washer material holds the washers in place.

2. A game of the battleship type which comprises a plurality of electrically conductive thumbtack type members of metal, with substantially flat heads and pointed shanks, a bulletin board tack type member having an elongated nonconductive handle and a conductive pointed metal shank, conductive wires, electrically connected to the thumbtack type members and to the bulletin board tack type member by being wrapped around the conductive shanks thereof, a plurality of electrically actuatable signals, a source of electricity, a surface member, a circuit board member and a grid sheet to be held in place on top of and as a visible part of the surface member, all of which are assembled into such game so that contact of the point of the bulletin board tack type member with the head of a thumbtack type member, made when the bulletin board tack type member passes through a grid sheet and the surface member, actuates an electrically actuatable signal by completing an electric circuit in which the signal is a part.

3. A game of the battle game type, playable by two players, in which the object of a second player is to determine the whereabouts of a plurality of target locations previously selected by a first player and not known to the second player, which comprises, in flat paperboard box form, a readily pierceable, visible, opaque surface member suitable as a cover for a box bottom member, and having a plurality of indicated locations thereon visible to the second player, a separable paperboard circuit board member under the visible surface member, having a plurality of corresponding indicated locations thereon, hidden from the second player by the opaque surface member while the game is being played but accessible to the first player during setting of the target locations, a bottom member, of flat box bottom shape, suitable for holding a battery and a circuit board member, a battery, a plurality of electrically actuatable lamps, at least two sets of a plurality of electrically conductive thumbtack contact members readily removably fastenable in place under the opaque surface member and at any of the plurality of indicated locations on the circuit board member, with the contact members of each set being joined to a wire conductor and the contact members of separate sets being joined to separate such conductors, which are independently joined to the same pole of the battery, and a pointed probe having a penetrating metal portion communicating with the battery by means of a wire conductor connected to it and capable of piercing the surface member and making electrical contact between the probe point and the head of a thumbtack contact member so as to complete any of a plurality of electric circuits including the battery, the thumbtack contact member, the probe and wire conductors, when in such contact, and a lamp in said circuit, so that when the point of the probe is in contact with a thumbtack head a lamp is lit which identifies the set of thumbtack contacts contacted, in which game the contacts of the conductive wires and the thumbtacks, and the conductive wire and the piercing portion of the probe are by said wires being wrapped about the shanks of the tacks and of the probe, respectively, and being maintained in position against head portions of said thumbtacks and said probe, respectively, by retainers on said shanks in contact with said wires and pressing them against the head portions, which retainers include openings sized slightly smaller than the respective diameters of said shanks, fitted over said shanks and held in place thereon due to the resiliency of the materials of said retainers.

4. A game of the battleship type which comprises a plurality of electrically conductive contact members, held to a circuit board comprising a grid, a matching opaque pierceable upper external paper grid sheet held in position above the circuit board grid, an electrically conductive pointed probe, with the contact members and the probe having head portions and having adjoining electrically conductive point portions connected to a source of electricity by conductive wires wrapped around them, and with synthetic organic polymeric plastic washers about such conductive portions holding the wires in contact with adjoining head portions of such contact members and the probe, which washers include openings smaller than the electrically conductive point portion diameters so that after installation on such portions the resiliency of the washer material holds the washers and the wires in place.

5. A kit for making a game of the battleship type which comprises a plurality of electrically conductive thumbtack type members of metal, with substantially flat heads and pointed shanks, a bulletin board tack type member having an elongated non-conductive handle and a conductive pointed metal shank, conductive wires, electrically connectable to the thumbtack type members and to the bulletin board tack type member by being wrapped around the conductive shanks thereof, a plurality of electrically actuatable signals, a surface member, a circuit board member and a plurality of grid sheets for holding in place on top of and as a visible part of the surface member, all of which are assemblable into a game in which contact of the point of the bulletin board tack type member with the head of a thumbtack type member, made when the bulletin board tack type member passes through a grid sheet and the surface member, actuates a signal when a battery or other source of electricity is included in an electric circuit which is completed by such contact.

6. A kit according to claim 5 which comprises a plurality of synthetic organic polymeric plastic washers for use as holding means for holding wires in contact with the tack heads, which washers include openings smaller than the tack shank diameters so that after installation on such tank shanks the resiliency of the washer material holds the washers in place.

* * * * *